United States Patent [19]

Bridges

[11] 4,402,535

[45] Sep. 6, 1983

[54] ADJUSTABLE BACKING ARRANGEMENT FOR PIPE SUSPENDING SLIPS

[75] Inventor: Charles D. Bridges, Houston, Tex.

[73] Assignee: Combustion Engineering, Inc., Windsor, Conn.

[21] Appl. No.: 244,775

[22] Filed: Mar. 17, 1981

[51] Int. Cl.[3] ..... E21B 19/10

[52] U.S. Cl. ..... 285/145; 166/382

[58] Field of Search ..... 285/145, 144, 146, 147, 285/148; 166/382

[56] References Cited

U.S. PATENT DOCUMENTS

| | | | |
|---|---|---|---|
| 1,887,865 | 11/1932 | Archer | 285/148 |
| 1,926,856 | 9/1933 | Leman | 285/144 X |
| 2,284,983 | 6/1942 | Minor | 285/144 |
| 2,315,134 | 3/1943 | Roach et al. | 285/144 |
| 2,775,472 | 12/1956 | Brown | 285/145 X |
| 3,051,513 | 8/1962 | Watts et al. | 285/147 X |

*Primary Examiner*—Thomas F. Callaghan

*Attorney, Agent, or Firm*—Cushman, Darby & Cushman

[57] ABSTRACT

A length-adjustable device is provided for use in applying setting force to a set of pipe slips, e.g. in a petroleum well. Then, the length of the device is adjusted and the device is installed on a seat in the head as a mechanical bridge between the set slips and an axially presented surface on an overlying part of the wellhead. Due to this interposition, the slips are prevented from losing gripping force as the suspended pipe expands and contracts.

17 Claims, 3 Drawing Figures

ADJUSTABLE BACKING ARRANGEMENT FOR PIPE SUSPENDING SLIPS

BACKGROUND OF THE INVENTION

In the context of petroleum well drilling and completion it is conventional to provide a wellhead equipment assembly at the well mouth for controlling ingress to and egress from the well in the presence of substantial and changing pressures, elevated temperatures. It is conventional to run strings of casing and tubing into such a well for various purposes and to hang such strings from their upper end regions from within the wellhead equipment assembly. Sometimes, for that purpose the string is provided near its upper end with a hanger connected thereto, which hanger seats in the wellhead equipment assembly. In other instances the hanging is accomplished by depositing into the annulus between a seat in the bore of the wellhead equipment assembly and the string of pipe an annular wedge and then axially compressing that annular wedge (usually called pipe slips) to radially expand it securely into frictionally gripping relation with the string of pipe.

Generally, after setting force is applied to pipe slips, the means or device used to apply the setting force is withdrawn, since the slips once set tend to stay set due to the weight of the suspended string of pipe.

However, especially with wells that are subject to an above-average amplitude of temperature cycling, e.g. between when they are producing hot fluids and when they are shut-in or being subjected to remedial procedures, there is some prospect in conventional systems, that the pipe, in expanding, will effectively enlarge the I.D. of the annular wedge provided by the slips, but that when the pipe contracts, the pipe slips will not retighten, and thus substantially and perhaps will crucially diminish their gripping force on the suspended pipe string.

SUMMARY OF THE INVENTION

A length-adjustable device is provided for use in applying setting force to a set of pipe slips, e.g. in a petroleum well. Then, the length of the device is adjusted and the device is installed on a seat in the head as a mechanical bridge between the set slips and an axially presented surface on an overlying part of the wellhead. Due to this interposition, the slips are prevented from losing gripping force as the suspended pipe expands and contracts.

The principals of the invention will be further discussed with reference to the drawings wherein preferred embodiments are shown. The specifics illustrated in the drawings are intended to exemplify, rather than limit, aspects of the invention as defined in the claims.

DETAILED DESCRIPTION

Figure 1:
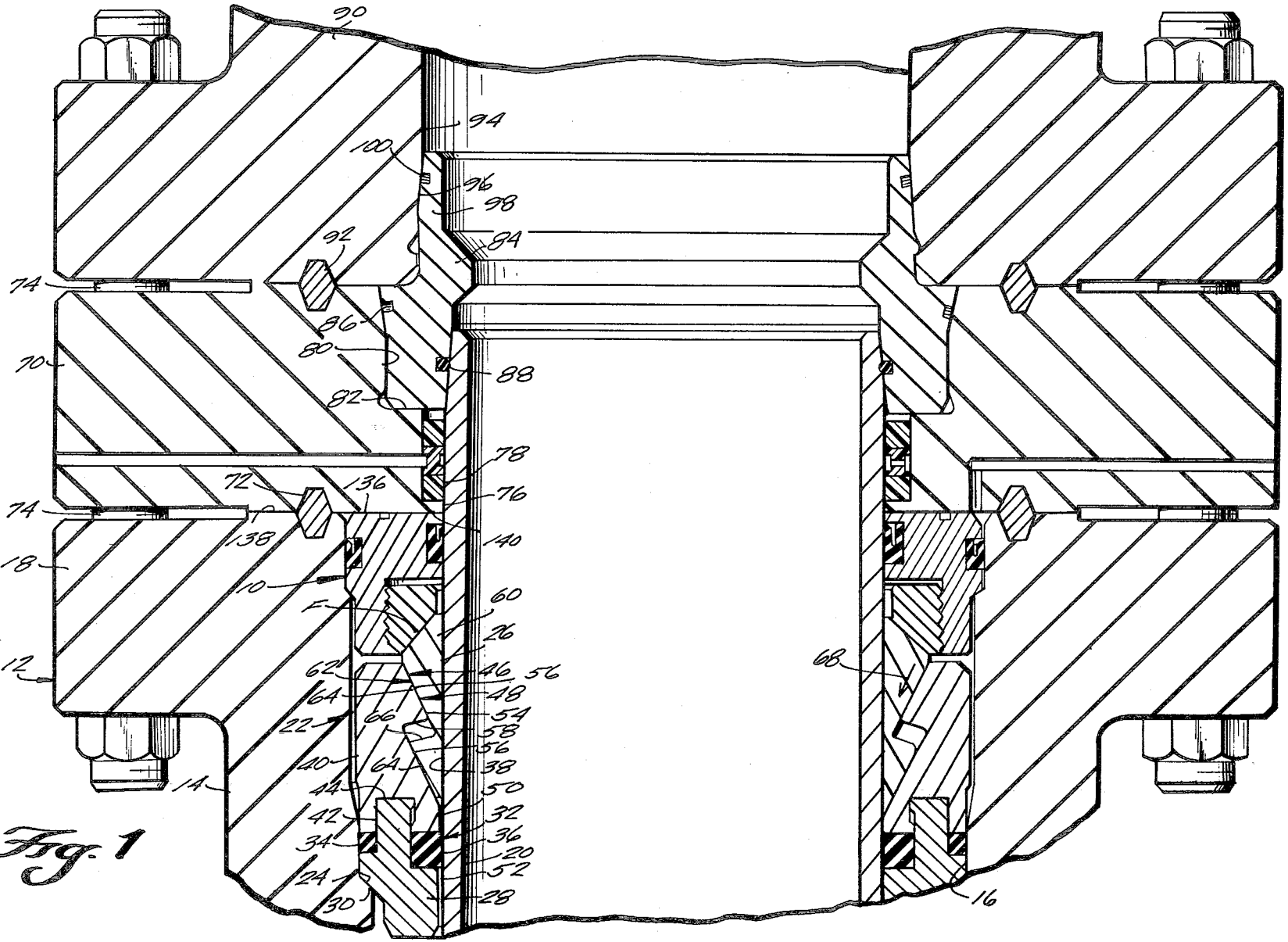
FIG. 1 is a fragmentary longitudinal sectional view of a wellhead equipment assembly provided with a device of the present invention.

In FIG. 1, the device of the present invention is shown at 10; other than for the presence of the device 10, FIG. 1 shows a typical conventional completion of a petroleum well, which is described as follows.

A casing head 12 is shown already installed at the well mouth. The casing head 12 includes a tubular body 14 having a vertically-oriented longitudinal bore 16. The casing head 12 terminates upwardly in an end flange 18 which is clamped and sealed to the next-upper wellhead part in order to maintain integrity of the confined space within the wellhead.

A string of casing 20 is shown supported in the well by a set of pipe slips 22, i.e. a pipe slip assembly in the form of an annular wedge, which seats on a circumferential seat 24 in the bore of the casing head, and frictionally grips the pipe string, e.g. with serrations on a radially inwardly presented surface means 26. These surface means generally circumferentially grip the pipe string externally near the upper end of the pipe string 20.

Typically, the pipe slip assembly includes a support ring 28, which includes the external, downwardly facing circumferential seat 30 by which the assembly is supported on the seat 24 in the casing head. On this support ring 28 typically is provided resilient sealing ring means 32 having a portion 34 presented radially outwards for sealing with the casing head bore and a portion 36 presented radially inwards for sealing with the radially outer perimetrical surface 38 of the pipe string. The typical set of slips further includes an annular bowl member 40 which is keyed to the support ring 28 at 42 for limited relative axial movement as needed to axially load the sealing ring means 32 upon setting of the slips. The annular bowl member is supported on the support ring 28 at 44, and includes as a specially shaped enlargement of the upper portion of its longitudinal bore 46, a slip bowl 48. Typically, the slip assembly at 50 and 52 just above and below the resilient sealing ring means radially inner portion 36 is of nearly as small a diameter as the free inner diameter of the sealing ring means portion 36, and only slightly larger than the outer diameter of the pipe string outer surface 38. This is to guard against extrusion of the seal material when the slips are set. However, as aforementioned, above the portion 52, the bore 46 opens up somewhat to provide a slip bowl. Within the slip bowl 48, the defining circumferential wall 54 is provided with one or more circumferentially extending wedging surfaces 56 which face radially inwards and axially upwards, e.g. at an angle of less than forty-five degrees to the longitudinal axis of the pipe string. In the instance shown, the slip bowl 48 is provided with two axially adjoining wedging surfaces 56 with a stepping shoulder 58 between them.

A plurality of slips 60 are recieved in the slip bowl 48. Each is a wedging element of the shape shown and, e.g. 15–90 degrees in angular extent, e.g. the plurality is collectively of segmented annular shape. Each slip has on its radially outer peripheral wall 62 a corresponding one or more wedging surfaces which face radially outwards and downwards, e.g. at an angle complementary to the angle of the respective wedging surfaces 56 of the slip bowl. In the instance shown the slips are provided with two axially adjoining wedging surfaces 64 with a stepping shoulder 66 between them. When the slips are not set, i.e. when the annular assembly 22 is being lowered into place about the pipe string so that it seats on the seat 24, the slips 60 are riding relatively high in the bowl 48, i.e. the wedging surfaces 64 facially engage but are located relatively further up the respective wedging surfaces 56 prior to slip setting.

The slips are set, e.g. by pushing down on them at F, in order to produce relative movement of the slips in the direction of arrow 68, and thus by axially shortening and radially thickening the slip annulus 22, force the slip serrated surfaces 26 into gripping engagement with the pipe surface 38.

Often the extent of axial compression of the slip assembly is limited by extinction of the spaces angularly between adjoining slips, i.e. when the slips come to all engage their neighbors, they cannot be moved significantly further down in the slip bowl. Other times the extent of axial compression of the slip assembly is limited by limiting the magnitude of the force F with which the slips are set.

In the typical conventional completion, once the slips have been set, whatever it was that applied the force F is simply withdrawn, and the slips tend to stay set due to inertia, friction and the weight of the suspended pipe string.

Generally the wellhead equipment assembly is further assembled after the slips 60 have been set. For instance, in FIG. 1, an annular bonnet adapter flange 70 is shown mounted on the upper end flange 18 of the casing head 12. Sealing is achieved between these two members at 72 and they are held clamped axially together e.g. by a ring of bolts, suggested at 74. Above the slip assembly 22, the bore 76 of the annular flange 70 is provided with a packing annulus 78 which is energized to circumferentially seal between the bore 76 and the radially outer peripheral surface 38 of the pipe string.

The upper portion of the bore 76 is coaxially annularly enlarged to provide an upwardly and radially inwardly opening annular recess 80 including an axially upwardly facing seat 82. This recess 80 is shown receiving an adapter sealing ring 84 which rests on the seat 82, seals with the bore 76 at 86 and seals with the pipe string radially outer perimetrical surface 38 at 88.

A further wellhead equipment assembly part, e.g. a tubing head 90 is shown sealed to and mounted on the bonnet adapter flange 70, e.g. via a sealing ring 92 and flange-to-flange clamping means such as the circle of bolts 74. The bore or downwardly open central cavity 94 of the tubing head or the like 86 is coaxially annularly enlarged adjacent its lower end to provide a downwardly and radially inwardly facing tapered seat 96. The adapter sealing ring 84 is shown having a tubular flange 98 which coaxially extends into the mouth of the bore 94 and seals with the seat 96 at 100.

What is believed to be different from the prior art about what is shown in FIG. 1 is largely centered upon the presence of the device 10 in this completed assembly. Turn now to FIG. 2 and it will be explained how the device 10 happened to get where it is and what it does there.

Figure 2:
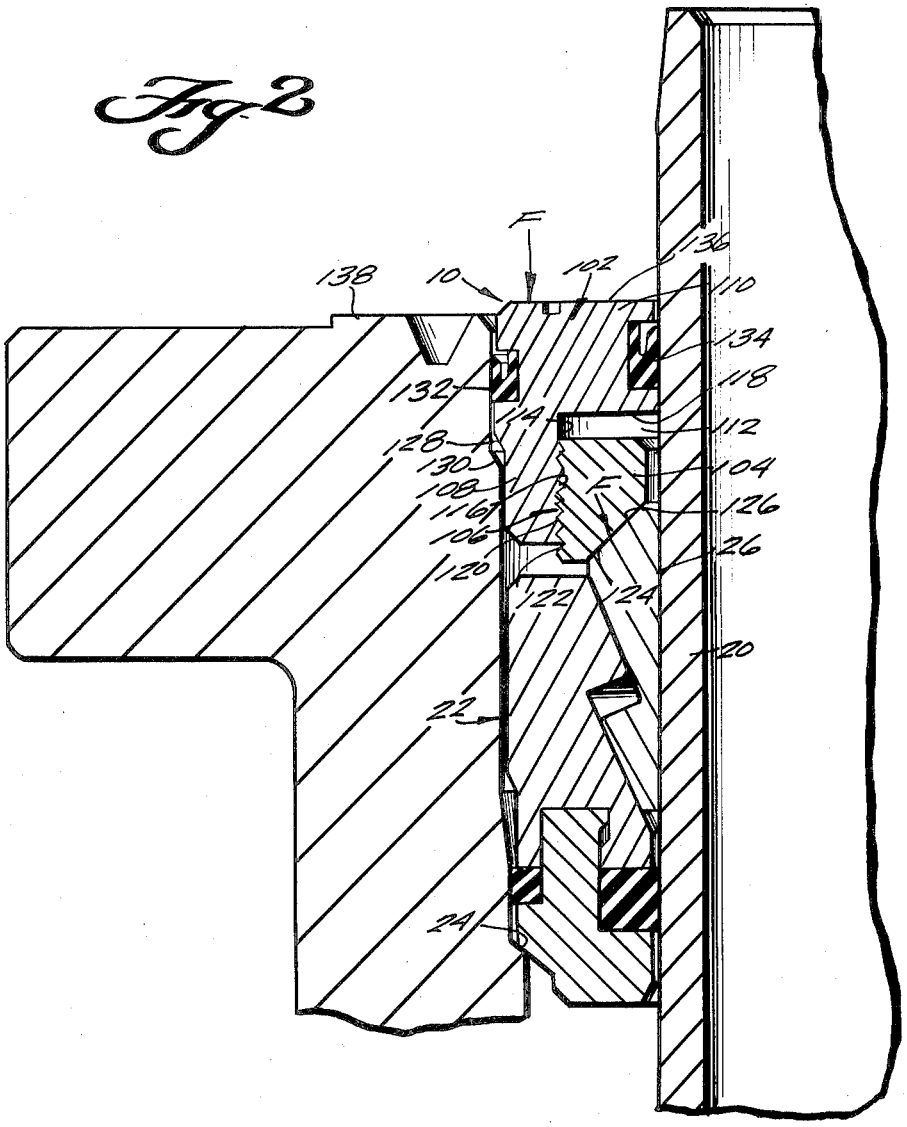
FIG. 2 is a fragmentary longitudinal sectional view similar to the left half of FIG. 1, but showing an earlier stage, in which the device of the present invention is being used to apply setting force to the pipe slips.

FIG. 2 depicts the situation where the string of pipe 20 has been run in the casing head bore 16 and the annular slip assembly has been lowered into the casing head bowl annularly between the head and the pipe string and has been landed on the seat 24. At this stage some other structure, not shown, is still being used to suspend the pipe string from above, because the slips are now being set. Until the slips are set, they would not reliably grip the pipe at 26.

The slips are set by pushing down on them with a force F as explaind hereinbefore. Whereas any means may be used to apply the force F, it is shown in FIG. 2 being applied through the agency of the adjustable backing arrangement 10. The device 10 is shown being constituted by an annular carrier 102 having an annular shoe or plug 104 threadedly joined thereto at 106.

In general, the carrier 102 is shown to include a radially outer, tubular body 108 with an integral radially in-turned flange 110 at the top, to thereby define an annular recess 112 in the radially inner, axially lower region of the cross-section of the carrier 102. This recess has a radially outer wall 114 that faces radially inwardly and has a band of internal threading 116 thereon, and an axially downwardly facing axially upper surface 118.

The annular shoe or plug 104 has a radially outer surface 120 which faces radially outwards and is provided with a band of external threading 122 thereon.

The lower inner corner of the shoe 104 is relieved on an incline, e.g. frustoconically at 124 at an angle to match the angle of a radially outwardly and axially upwardly facing tapering surfaces 126 on the slips.

The device 10 is assembled by threading the shoe 104 partly into the carrier recess 112 by partly making-up the threads at 106. For use in setting the slips, the device 10 is placed in the casing head/pipe string annulus, above the slip assembly and lowered until the shoe surface 124 facially engages the tapering surfaces 126 of each of the slips.

It should be noted that because for this use the device 10 is not as axially condensed as it would be if the threading were made up all the way at 106, whereas the shoe 104 engages the slips 60, the external, circumferential axially downwardly facing shoulder 128 on the carrier remains disposed above and is not at this time seated on the complementary circumferential axially upwardly facing shoulder 130 coaxially formed in the bore 16 near the upper end of this bore. However, annular sealing rings 132 and 134 provided in respective radially outwardly opening and radially inwardly opening grooves in the upper part of the carrier, above the shoulder 128 and above the recess 112, respectively, do respectively slidingly sealingly engage the casing head 12 in the bore 16 and the outer perimetrical surface 38 of the pipe string.

The slips are set by then pushing down on the carrier 102 with a force F, using any convenient means.

Now assume that FIG. 2 depicts what the structure looks like just after the slips have been set by applying force F. Note that the axially upwardly facing surface 136 of the carrier 102 lies above the level of the surrounding axially upwardly facing surface 138 of the casing head 12.

At this point the device 10 may be axially withdrawn from the annular space in which it is shown received, and the two parts 102, 104 may be rotated relative to one another in a sense to make-up the threads at 106 a little more, i.e. to axially shorten the device 10 by the amount of the difference in height between the levels of the surfaces 136 and 138. Then the thus adjusted device 10 may be put back in place.

Now it will appear as shown in FIG. 1, i.e. the underside of the shoe will engage and axially back-up the slips and the level of the top of the carrier at 136 will match the level of the surface 138 of the head 12.

In the embodiment shown in FIG. 1, the annular bonnet adapter flange 70 has an axially downwardly facing annular surface 140 which extends radially inwardly sufficiently to overlyingly engage the carrier surface 136. (If in a particular well the surface 140 is not at the same level as the surface 138, then, in threadedly adjusting the axial height of the device 10, the surface 136 is brought to the height of the surface 140, with the carrier seated on its seat in the head bore.) Thus, when the wellhead is assembled, the device 10 serves as a mechanical bridge to prevent the slips from rising in the slip bowl. As the pipe string expands and contracts, the device 10 ensures that the slips will remain set.

Figure 3:
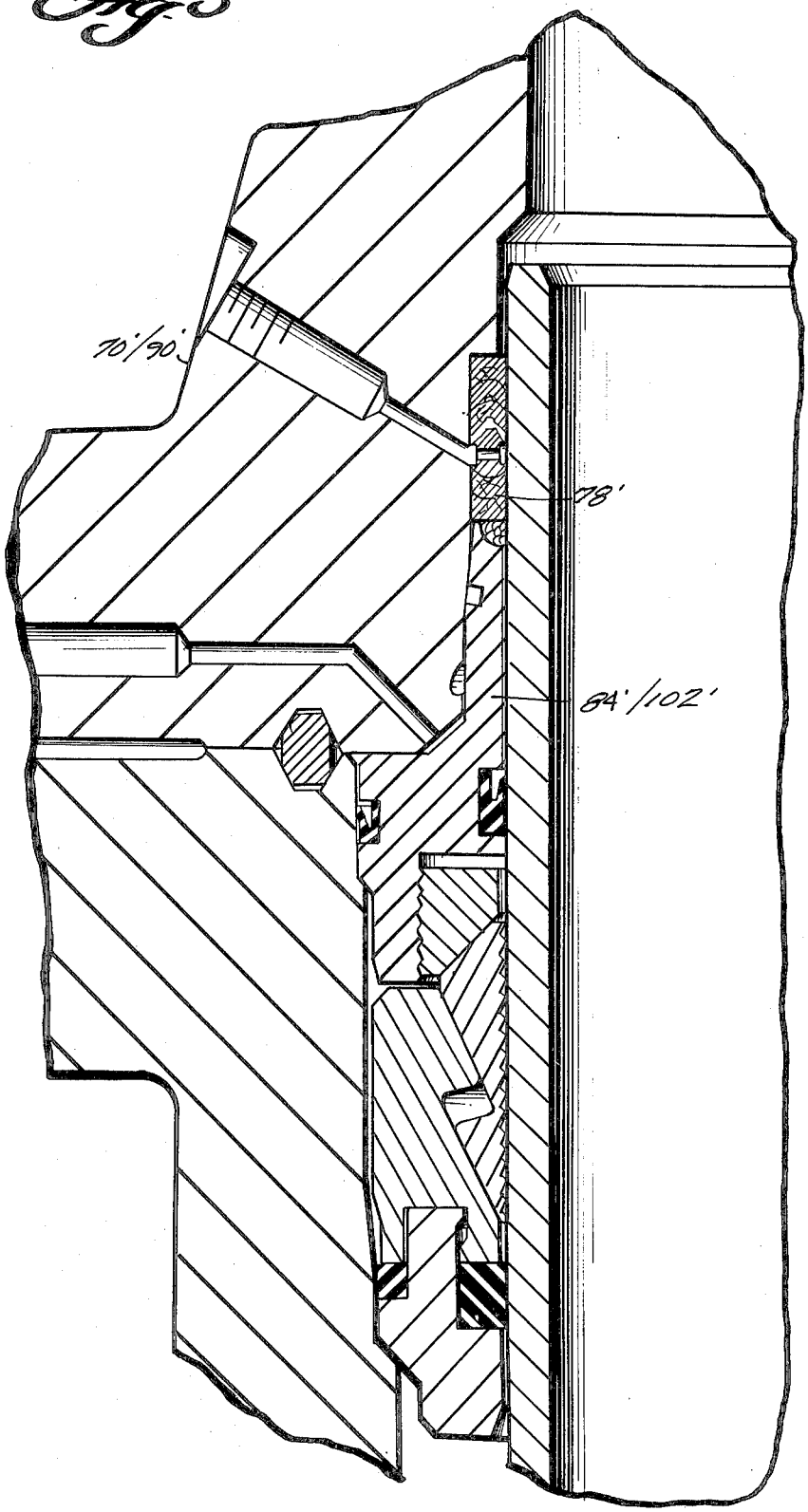
FIG. 3 is a fragmentary longitudinal sectional view similar to the left half of FIG. 1, but of a device of the invention modified to fit another style of well completion.

A modification is shown in FIG. 3. For orientation, some comparable parts have been given the same numerals as in FIGS. 1 and 2, but with primes. The principally different features are that the bonnet adapter flange 70 and bonnet 90 are combined into an integral bonnet structure 70'/90', the carrier 102 is integrated with the pipe string-to-bonnet bore seal member 84 as an integral carrier structure 84'/102', and the packing annulus 78 is displaced in location from between the seal member 84 and the carrier 102 to 78', above the integral carrier structure 84'/102'. Simplification of assembly will be understood by those skilled in the art; the function provided remains as explained above for the principal embodiment.

It should now be apparent that the adjustable backing arrangement for pipe suspending slips as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. For a wellhead assembly that includes:

a head having a vertical bore in which a pipe string is to be hung from a shoulder means provided in the bore, via an annular slip assembly which includes a support means seated on the shoulder means, a slip bowl-providing member supported upon the support means and a set of pipe slips supported in the slip bowl for gripping relation with the pipe string and thus bridging an annular space between the shoulder means in the head bore, and the pipe string; and a further wellhead structure provided with means for removably mounting it to said head in overlying relation to said head, a setting and bridging device, comprising:

a carrier;

a shoe; and means height adjustably dependently connecting the shoe with the carrier;

said device being receivable in said annular space, radially between the pipe string and the head bore, with the shoe in slip-setting relation with the pipe slips;

said carrier including means for seating said device in the head bore independently of the slip assembly so that the device may be lowered into the annular space and independently seated with respect to the head, provided the connecting means is so adjusted that the shoe does not first engage the slips in said slip-setting relation; and said carrier including surface means positioned to be overlyingly abutted by said further wellhead structure when said carrier is seated in said head bore via said seating means, upon corresponding adjustment of said connecting means, so that said connecting means may first be adjusted to permit the shoe to engage the pipe slips in slip-setting relation thereto, with the carrier projecting above where its seating means can seat in said head bore for receipt of application of a downward force applied to the carrier to effect setting of the pipe slips and then be adjusted to permit the carrier to seat in the head bore via its seating means, with the shoe in slip-setting relation to the pipe slips, whereby the device is arranged to serve as a mechanical bridge between the pipe slips and the further wellhead structure, for preventing the pipe slips from unsetting as the pipe string is thermally cycled.

2. The setting and bridging device of claim 1, wherein:

the shoe and carrier are formed as respective annuli.

3. The setting and bridging device of claim 2, wherein:

the means height adjustably dependently connecting the shoe with the carrier is constituted by a threaded interconnection of said shoe to said carrier.

4. The setting and bridging device of claim 3, wherein:

the carrier includes a ring portion of generally inverted L-shape in longitudinal section, so as to have a downwardly and inwardly opening recess having an axially upper wall and a radially outer peripheral wall, said radially outer peripheral wall being internally threaded; and the shoe includes a radially outer peripheral surface that is externally threaded;

the internal threading on said carrier being threadedly engaged with the external threading on said shoe to provide said threaded interconnection constituting said means height adjustably connecting the shoe with the carrier.

5. The setting and bridging device of claim 4, wherein:

the shoe includes a radially inwardly and axially downwardly-presented circumferential tapering surface positioned for slip-setting engagement with the pipe slips, so that as said shoe is pushed axially downwards said shoe tends to urge the pipe slips down the slip bowl and thus radially inwards against the pipe string.

6. The setting and bridging device of claim 2, wherein:

the carrier further includes an externally presented circumferentially-extending sealing means for sealing engagement with the head bore and an internally presented circumferentially-extending sealing means for sealing engagement with the pipe string.

7. The setting and bridging device of claim 2, wherein:

the carrier includes a ring portion having an axially upwardly presented end surface constituting said surface means positioned to be overlyingly abutted by said further wellhead structure and to have said downward force applied thereto.

8. The setting and bridging device of claim 7, wherein:

the carrier further includes an axially upwardly extending tubular portion integrally based on said ring portion radially inwardly of said axially upwardly presented end surface;

said tubular portion having annular sealing means circumferentially provided thereon for sealing with said further wellhead structure.

9. A wellhead assembly including:

a head having a vertical bore;

a pipe string extending up through said vertical bore with radial spacing therefrom to provide an annular space therebetween;

a first shoulder means provided in said bore;

an annular slip assembly received in said annular space;

said annular slip assembly including a support means seated on said first shoulder means, a slip bowl-providing member supported upon the support means, and a set of pipe slips supported in the slip bowl for gripping relation with the pipe string thus bridging said annular space and supporting the pipe string from said first shoulder means;

means providing a second shoulder in said bore, located above said first shoulder;

a further wellhead structure;

means for removably mounting the further wellhead structure to said head in overlying relation to said bore;

a setting and bridging device comprising:

a carrier;

a shoe; and means height adjustably dependently connecting the shoe with the carrier;

said device being receivable in said annular space, radially between the pipe string and the head bore, with the shoe in slip-setting relation with the pipe slips;

said carrier including means for seating said device in the head bore on said second shoulder independently of the slip assembly so that the device may be lowered into the annular space and independently seated with respect to the head, provided the connecting means is so adjusted that the shoe does not first engage the slips in said slip-setting relation; and said carrier including surface means positioned to be overlyingly abutted by said further wellhead structure when said carrier is seated in said head bore via said seating means, upon corresponding adjustment of said connecting means, so that said connecting means may first be adjusted to permit the shoe to engage the pipe slips in slip setting relation thereto, with the carrier projecting above where its seating means can seat in said head bore for receipt of application of a downward force applied to the carrier to effect setting of the pipe slips and then be adjusted to permit the carrier to seat in the head bore via its seating means, with the shoe in slip-setting relation to the pipe slips, whereby the device is arranged to serve as a mechanical bridge between the pipe slips and the further wellhead structure, for preventing the pipe slips from unsetting as the pipe string is thermally cycled.

10. The wellhead assembly of claim 9, wherein:

the shoe and carrier are formed as respective annuli.

11. The wellhead assembly of claim 10, wherein:

the means height adjustably dependently connecting the shoe with the carrier is constituted by a threaded interconnection of said shoe to said carrier.

12. The wellhead assembly of claim 11, wherein:

the carrier includes a ring portion of generally inverted L-shape in longitudinal section so as to have a downwardly and inwardly opening recess having an axially upper wall and a radially outer peripheral wall, said radially outer peripheral wall being internally threaded; and the shoe includes a radially outer peripheral surface that is externally threaded;

the internal threading on said carrier being threadedly engaged with the external threading on said shoe to provide said threaded interconnection constituting said means height adjustably connecting the shoe with the carrier.

13. The wellhead assembly of claim 12, wherein:

said ring portion of said carrier includes an outer peripheral surface having a circumferentially extending, downwardly facing shoulder providing said means for seating said device in the head bore on said second shoulder.

14. The wellhead assembly of claim 12, wherein:

the shoe includes a radially inwardly and axially downwardly-presented circumferential tapering surface positioned for slip-setting engagement with the pipe slips, so that as said shoe is pushed axially downwards said shoe tends to urge the pipe slips down the slip bowl and thus radially inwards against the pipe string.

15. The wellhead assembly of claim 10, wherein:

the carrier further includes an externally presented circumferentially-extending sealing means for sealing engagement with the head bore and an internally presented circumferentially-extending sealing means for sealing engagement with the pipe string.

16. The wellhead assembly of claim 10, wherein:

the carrier includes a ring portion having an axially upwardly presented end surface constituting said surface means positioned to be overlyingly abutted by said further wellhead structure and to have said downward force applied thereto.

17. The wellhead assembly of claim 16, wherein:

the carrier further includes an axially upwardly extending tubular portion integrally based on said ring portion radially inwardly of said axially upwardly presented end surface;

said tubular portion having annular sealing means circumferentially provided thereon for sealing with said further wellhead structure.

* * * * *